US010624436B1

(12) United States Patent
Davis

(10) Patent No.: US 10,624,436 B1
(45) Date of Patent: Apr. 21, 2020

(54) HAIR SOLUTIONS CART

(71) Applicant: Khadijah Davis, Orange, NJ (US)

(72) Inventor: Khadijah Davis, Orange, NJ (US)

( * ) Notice: Subject to any disclaimer, the term of this patent is extended or adjusted under 35 U.S.C. 154(b) by 0 days.

(21) Appl. No.: 16/707,427

(22) Filed: Dec. 9, 2019

(51) Int. Cl.
*A45D 44/02* (2006.01)
*A45D 44/14* (2006.01)

(52) U.S. Cl.
CPC ..... *A45D 44/02* (2013.01); *A45D 44/14* (2013.01); *A45D 2200/155* (2013.01)

(58) Field of Classification Search
CPC ... A45D 44/02; A45D 44/14; A45D 2200/155
USPC ..... 4/516, 515
See application file for complete search history.

(56) References Cited

U.S. PATENT DOCUMENTS 3,711,021 A * 1/1973 Tantillo ..... A45D 44/02 248/579
4,549,664 A * 10/1985 Gowan ..... B25H 3/025 211/131.1
6,076,202 A * 6/2000 Lockwood ..... A45D 19/04 4/515
7,159,728 B2 1/2007 Smith
7,343,921 B2 * 3/2008 Salinas ..... A41G 5/004 132/201
8,998,002 B1 4/2015 Milner
2009/0008347 A1 * 1/2009 Bell ..... A45D 44/02 211/61
2012/0192427 A1 * 8/2012 Hazard ..... A45D 24/36 132/200

* cited by examiner

*Primary Examiner* — Tuan N Nguyen
(74) *Attorney, Agent, or Firm* — Walter J. Tencza, Jr.

(57) ABSTRACT

An apparatus including a vertical member; a top plate rotatably mounted to the vertical member; and a bowl connected to the top plate so that the bowl rotates with respect to the vertical member when the top plate rotates. The top plate has at least a first section which can be placed in a first state in which the first section covers the majority of an opening at the top of the bowl, and in a second state in which the first section does not cover the majority of the opening at the top of the bowl; and wherein the bowl is configured to retainer water. The apparatus typically includes a heater connected to the bowl, powered to provide heat to the bowl to heat water in the bowl. The apparatus may further include a tube surrounding the top plate except for a gap at a location adjacent the bowl.

20 Claims, 4 Drawing Sheets

HAIR SOLUTIONS CART

FIELD OF THE INVENTION

This invention relates to improved methods and apparatus concerning hair stands.

BACKGROUND OF THE INVENTION

There are various devices known for hair stands which provide ways of installing hair extensions.

One popular way of installing hair extensions is using "bundled hair" which uses a weft to hold the individual pieces of hair together. The weft is then sewn down onto the client's natural hair.

U.S. Pat. No. 8,998,002 to Milner discloses a vertical member having a plurality of openings for inserting a plurality of combs. Each of the combs has teeth for holding one or more hair extensions.

U.S. Pat. No. 7,159,728 to Smith discloses an annular rim with notches disposed therein to hold a plurality of skeins of hair.

SUMMARY OF THE INVENTION

At least one embodiment of the present invention provides a hair stand that will be used to assist beauticians in every hair salon, beauticians that work from home, and travel from place to place to assist their celebrity clients while completing various hairstyles. One or more embodiments, of a hair stand in accordance with the present invention, allow an individual to install hair extensions in a number of different ways, incorporated into one hair stand. One or more embodiments of the present invention were created to limit the hassle of placing hair in places where the hair doesn't belong such as around a beautician's neck, in the hair stylist drawer, or having the customer hold the hair etc.

One or more embodiments of the present invention, make the space around a hair stand neater, and save the stylists a few extra minutes on each hairstyle because the hair stand allows the use of different accessories. In at least one embodiment, there are at least four different modules that are used on this hair stand, each providing a different way to install hair extensions.

The first module may be called a "double slot weft holder", in which both of two slots are typically plastic and an inch wide, which is a total of three inches wide and five inches long. The two slots are transparent to slide hair through. In between these slots there is a one inch thick line that keeps the slots separated and which is not transparent. There is also a blade at the end of the two slots that is used to cut the weft. A small plastic cover is typically on top of the blade for safety reasons.

The second module is a water boiler for hair braiding use. The second module may be seven inches wide including a "Wide U-Shape Area" for a client's neck to fit comfortably on. The water boiler second module may be made with a pot with glazed ceramic and with an additional electric heating element. In at least one embodiment, the pot is able to slide in and out for cleaning and traveling purposes and has a plastic lid to cover it while attached to the overall hair stand. Along with the water boiler, in at least one embodiment, there are a plurality of hooks, such as twenty hooks that are able to fold in and out; the hooks go all the way around a two inch disc except for an area where the client's neck fits. The plurality of hooks also typically have two curved ends on it to hold an individual's braiding hair.

The third module or feature holds a comb that may be five inches long. The comb keeps cold fusions in place while a beautician attaches a plurality of strands, one by one.

The fourth module or feature is a "Clip In" extensions. The fourth module may have an area with a width of six inches, which holds a plurality of small individual metal strips, such as twenty, that are about an inch long to attach each row of extensions.

The height measurements for this adjustable hair stand may be between thirty inches and thirty-nine and one half inches. The circular disc may be about two inches thick, twenty inches wide, and twenty inches long. The disc may also be able to rotate and tilt. One plastic basket may be used to hold hair. Four metal push buttons may be used to hold or adjust the hair stand. Four wheels may be used to glide the hair stand wherever a beautician desires to put it. Wheels may be protected by a plastic cover.

To assist with installing wefts, in at least one embodiment, a weft feeder is provided with a hair stand in the present invention, as well as a basket. The basket holds the hair and is fed through the weft holder from underneath. The weft feeder can also be used to do "glue in, tape in" hair installments as well.

In at least one embodiment, there is an automatic stopper used to hold the hair in place and a blade which has a cover over it for safety reasons. The blade is used to cut the weft to the desired length that the hair stylist needs. The weft feeder has a double slot, because hair goes in on one side and is fed through the other side. The weft feeder keeps hair in place so that it doesn't fall underneath back into the basket. There is also a tray with a small area to hold a needle and thread. A plastic stick may be provided to place a thread onto to make sure the thread is stationary while a needle is being threaded.

The second module may be a hair braiding section. The "U Shape" section of the second module is an area where the client's neck can fit comfortably into the stand. The "U Shape" section is able to tilt to make it easier for the client and the beautician to proceed with completing the hair style. With the hair braiding section, there are additional pieces used to assist. Like the water boiler. The water boiler is used when beauticians are braiding hair and afterwards the hair is dipped in hot water to assist with a cleaner and sleeker look and brings a bit more shine to the finished style.

The fourth module to add to the hair braiding section is the foldable hooks that go all the way around the wheel except for the neck area to hold synthetic or human braiding hair. Each hook may have two curved additional hooks to hold the hair whether they have the three pieces of hair together to start braiding or three strands of hair that is separately taken apart so that the stylist can mend all three pieces to start their braid. Also, there is a metal latch that is four inches long and moves in a forward backward motion and snaps into place to hold larger amounts of hair as well.

A fifth feature to a hair stand, in accordance with an embodiment of the present invention, is a section used for clip in extensions. In the end these extensions with the clips attached will go onto the client's natural hair. There are thin metal strips which will hold the "clip-in" installments into place while the beautician is getting ready to install the extensions piece by piece onto the client's natural hair.

Lastly, a sixth module is a cold/hot fusion holder, which includes individual strands of hair put together and bonded together. It creates thicker strands of hair and can create thicker and longer hair for the client. The beautician sits the thicker strands inside of a comb in between each tooth. One by one the strands are attached to the client's natural hair, providing the desired style needed.

In at least one embodiment of the present invention an apparatus is provided comprising: a vertical member; a top plate rotatably mounted to the vertical member; and a bowl connected to the top plate so that the bowl rotates with respect to the vertical member when the top plate rotates; wherein the top plate has at least a first section which can be placed in a first state in which the first section covers the majority of an opening at the top of the bowl, and in a second state in which the first section does not cover the majority of the opening at the top of the bow; and wherein the bowl is configured to retainer water.

The apparatus may further include a heater connected to the bowl, which can be powered to provide heat to the bowl to heat water in an inner chamber of the bowl.

The apparatus may further include a tube fixed to the top plate; and wherein the top plate is substantially circular and the tube surrounds the top plate except for a gap at a location adjacent the bowl. A plurality of hooks may be fixed to the tube; and each of the plurality of hooks may be configured to hold one or more hair extensions.

The apparatus may further include a cutting device fixed to the top plate; and wherein the cutting device is configured to cut hair. The top plate may have first and second arcuate slots separated by an arcuate band; wherein one or more hairs can be inserted into the first arcuate slot, underneath the arcuate band, and then through the second arcuate slot.

The apparatus may further include a foam needle holder fixed to the top plate. A first type of comb may be fixed to a second section of the top plate; a second type of comb may be fixed to a third second of the top plate; wherein the first type of comb is at least twice as long as the second type of comb; and wherein the first type of comb and the second type of comb are configured to hold one or more hair extensions.

In at least one embodiment, the top plate may be configured to tilt with respect to the vertical member. The apparatus may include a base; and a basket fixed to the vertical member at a location between the top plate and the base.

In at least one embodiment a method is provide including the steps of: placing water into an inner chamber of a bowl; and heating the water in the inner chamber of the bowl. The bowl may be part of an apparatus in one or more embodiments, as previously described.

DETAILED DESCRIPTION OF THE DRAWINGS

Figure 1:
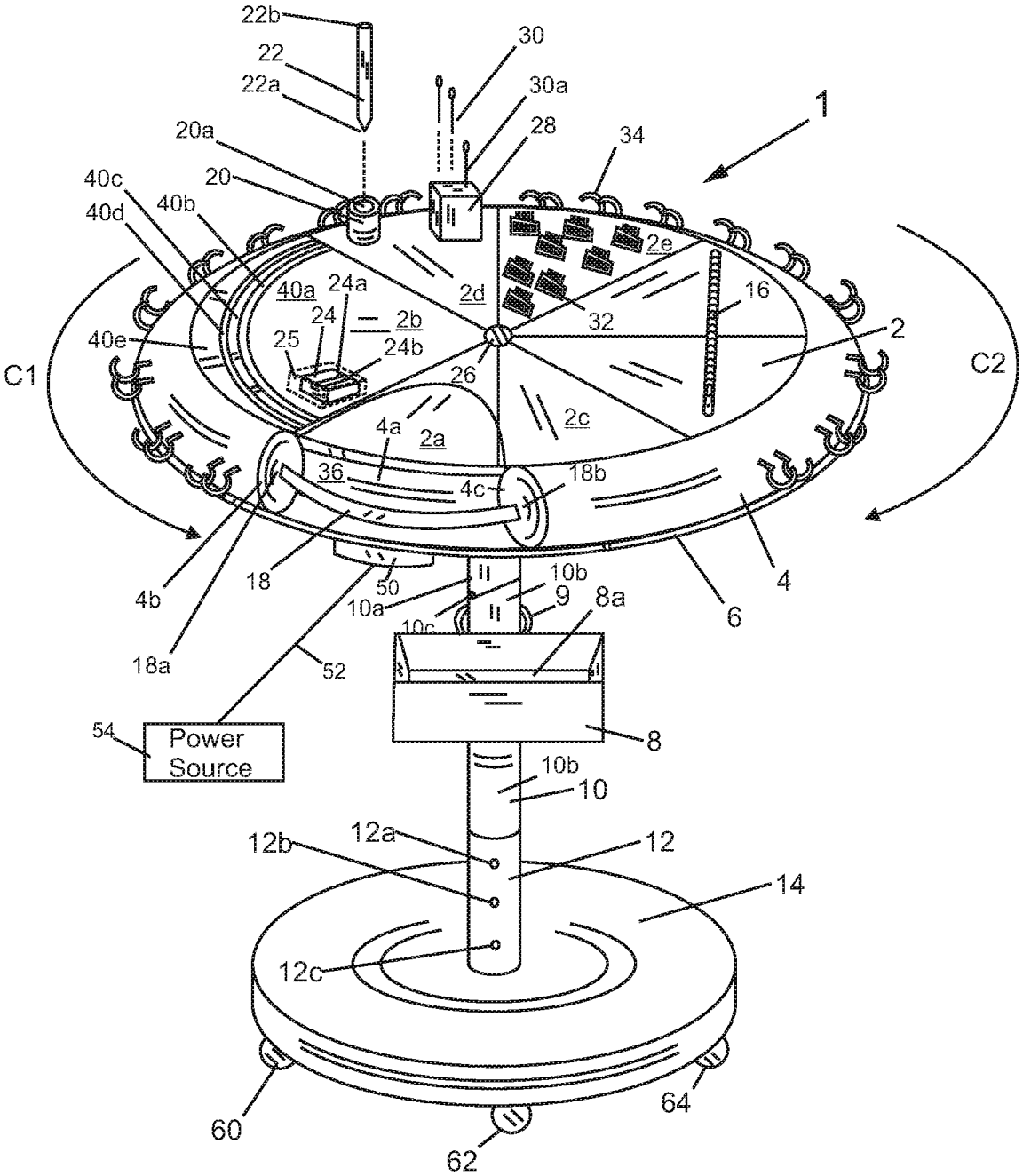
FIG. 1 shows a perspective view of an apparatus in accordance with an embodiment of the present invention, with the apparatus of FIG. 1 shown in a first state.

FIG. 1 shows a perspective view of an apparatus 1 in accordance with an embodiment of the present invention.

The apparatus 1 includes a top plate 2, a tubular structure 4, a bottom plate 6, a receptacle 8, a pole 10, a cylinder 12, a base 14, a comb structure 16, a wire 18, an cylinder 20, a needle and thread holder 22, a cutting device 24, a pivot pin or screw 26, a needle holder 28, a plurality of needles 30, including needle 30*a*, a plurality of comb structures 32, and a plurality of hooks 34. The apparatus 1 also includes a bowl or receptacle 36 underneath a pie section 2*a* of the top plate 2. The bowl or receptacle 36 has an inner chamber 36*a* into which items can be placed. The pie section 2*a* can be folded up, along lines with pie sections 2*b* and 2*c* to allow access to inner chamber 36*a*. The needle and thread holder 22 may be a short plastic stick to hold thread and foam bar to hold needles.

The top plate 2, is attached to the tubular structure 4 which is attached to the bottom plate 6. The tubular structure 4 goes all the way around the top plate 2 and the bottom plate 6, except for a gap 4*a* in which the wire 18 is located. The wire 18 has an end 18*a* fixed to end 4*b* of the tube 4 and an end 18*b* fixed to end 4*c* of tubular structure 4.

The receptacle 8 has an inner chamber 8*a* which is bordered and/or defined by a peripheral wall and a bottom surface. The receptacle 8 may be an open box structure where items can be placed into the inner chamber 8*a* through an opening at the top. The receptacle 8 may be attached to the pole 10 by an attachment device 9, such as a ring and screws, and/or a clamp and/or any other attachment device.

The pole 10 may telescope in the cylinder 12 to set components 2, 4, and 6 at various heights by use of pins and/or openings 12*a*, 12*b*, and 12*c*.

Figure 2:
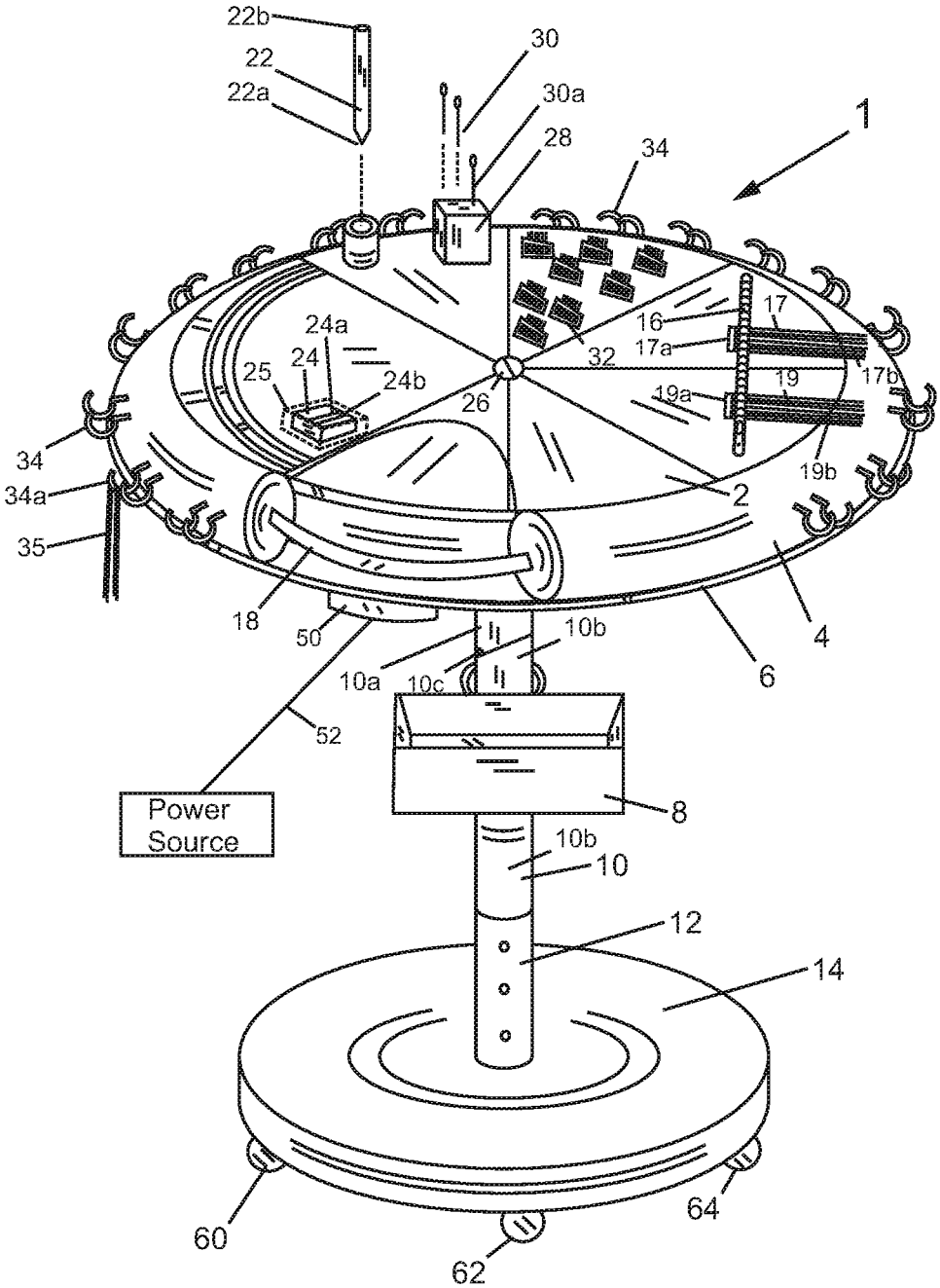
FIG. 2 shows the perspective view of the apparatus of FIG. 1, along with some additional components, with the apparatus of FIG. 1 shown in the first state.

FIG. 2 shows the perspective view of the apparatus 1 of FIG. 1, along with some additional components.

In operation, the apparatus 1 provides a number of stations for hair care or hair treatments.

A wig or a plurality of strands of hair can be placed on, laid on, and/or suspended on wire 18. A hair strand can be cut by inserting a hair strand into opening 24*b* of device 24 and cutting the hair strand with blade 24*a* of the device 24.

Hair strands, such as hair stands strands 35 in FIG. 2, can be placed on, laid over, and/or otherwise suspended from any one of hooks 34 surrounding and inserted in the tube 4, such as hook 34*a*.

An needle and thread holder 22 having a point end 22*a* and an opposing end 22*b* can be at least partially inserted, point 22*a* end first, into an inner chamber 20*a* of the cylinder 20, to attach the needle and thread holder 22 to apparatus 1 for later use, and easy accessibility. In at least one embodiment, the cylinder 20 is fixed to the plate 2 or to a section of the plate 2.

Sewing needles or other needles or pins, such as pins or needles having eye openings 30 may be inserted point first into a cushion or foam holder 28, to attach the pins 30 to apparatus 1 for later use and easy accessibility. Foam holder 28 may be fixed to plate 2 or to a section of plate 2.

Hair extensions may be attached to any one of comb structures 32 shown in FIG. 1. Air extensions may also be attached to the comb structure 16, such as hair extensions 17 and 19 shown in FIG. 2. The hair extensions 17 and 19 include attachment portions 17*a* and 19*a*, and hair portions 17*b* and 19*b*, respectively.

The pin 26 is fixed to the pole 10 in a manner which allows the combination of the top plate 2, tube 4, and bottom 6 to rotate in a counterclockwise C1 or clockwise C2 direction with respect to the pole 10. The cylinder 12 fixed to the base 14, so that the pole 10 and cylinder 12 are perpendicular or substantially perpendicular to the base 14. The ability of the structure 2, 4, and 6 to rotate with respect to the pole 10 and the base 14 allows a user of the top plate 2, tube 4, and bottom 6 structure to easily access different stations without moving from a sitting position.

The pie section 2*b* of the top plate 2 includes a body section 40*a*, an opening or slot 40*b*, a band or strip 40*c*, an opening or slot 40*d*, and an outer band 40*e*. A material, such as a plurality of strands of hair can be slid through the opening or slot 40*b*, under the band 40*c*, and out the opening or slot 40*d*, held by band 40*c*, and then cut or otherwise manipulated.

In at least one embodiment, each the slots 40*b* and 40*d* may typically have an arc length, which may be about five inches spanning from the junction of sections 2*a* and 2*b* to the junction of sections 2*b* and 2*d*. The slot 40*d*, because it is on the outside would have a somewhat larger arc length than the slot 40*c*. Each of the slots may have a narrow opening width, such as less than one inch. The slots 40*b* and 40*d* may be described as being part of a first module. The two slots 40*b* and 40*d* allow hair to slide through them. In between these slots 40*b* and 40*d* there is a one inch thick line or band 40*c* that keeps the slots separated. The band 40*c* may have an arc length of about five inches. There is also a blade 24*a* at the end, or located near the two slots 40*b* and 40*d* that's used to cut a weft, or plurality of strands of hair. A small removable plastic cover 25, shown by dashed lines in FIGS. 1 and 2, is typically on top of the blade 24*a* for safety reasons, when the blade 24*a* is not being used.

Figure 3:
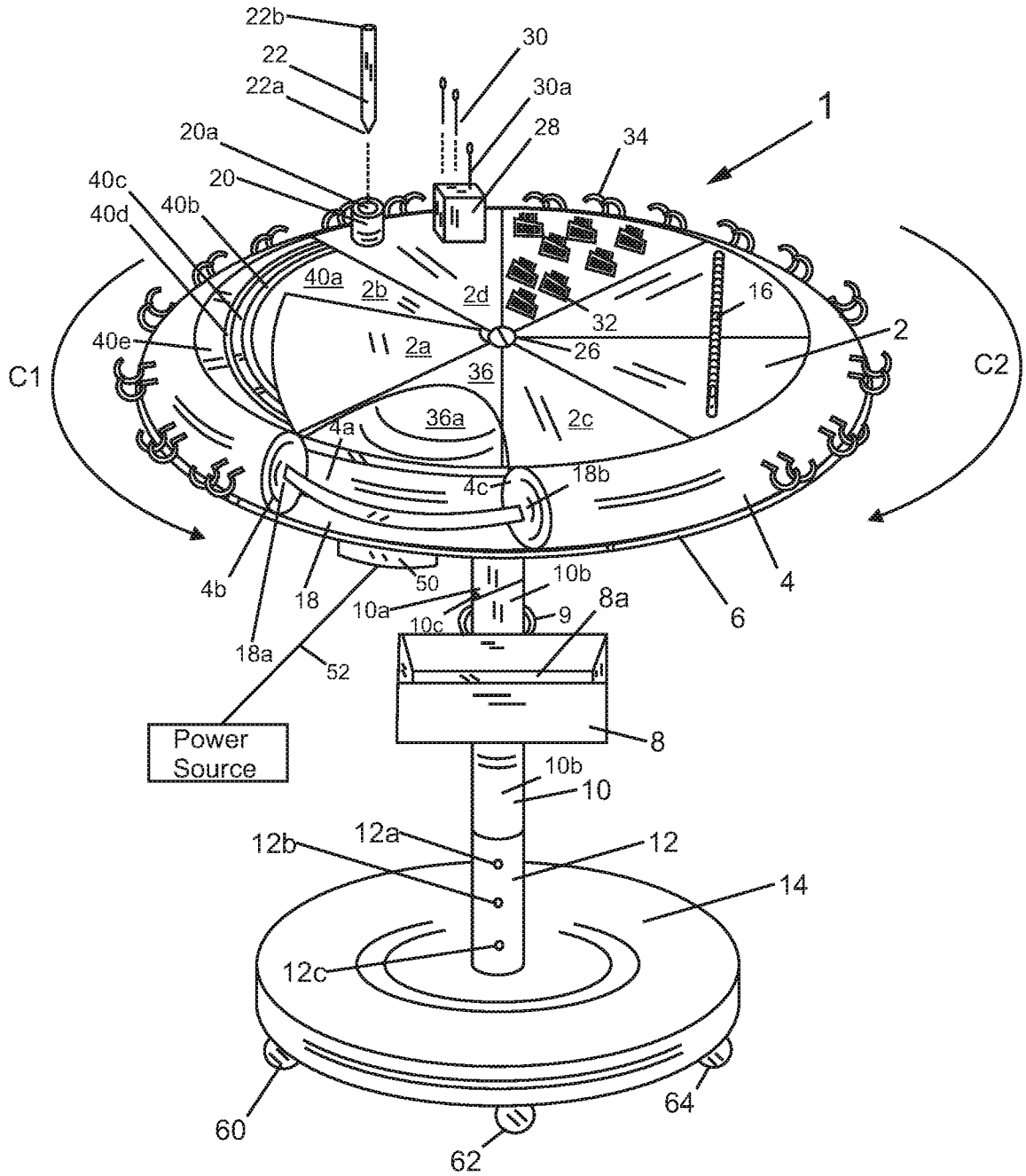
FIG. 3 shows a perspective view of the apparatus of FIG. 1, shown in a second state, where a section has been folded to expose an inner chamber of a bowl.

The bowl 36 may be used as a water boiler for hair braiding use, and may be part of a second module. The gap 4*a* in the tube 4, allows a person's neck and to be inserted in the gap 4*a* to dip their hair in hot or boiling water located in the inner chamber 36*a* of the bowl 36 when the pie section 2*a* has been folded open as shown in FIG. 3. The gap 4*a* may have an arc length of seven inches and/or may be seven inches wide including a "Wide U-Shape Area" for a client's neck to fit comfortably on. The water boiler second module may be made with a pot with glazed ceramic for the bowl 36, and with an heating element 50 underneath or adjacent to the bowl 36 for heating water inside the inner chamber 36*a*. The heating element 50 may be connected by an electrical cord 52 to a power source 54, such as to an electrical AC (alternating current) outlet or to a batter.

In at least one embodiment, the pot or bowl 36 is able to slide in and out from outside the circular regions of top plate 2, and bottom plate 6, for cleaning and traveling purposes and may have a plastic lid or pie shaped section 2*a* to cover the bowl 36 while attached to the overall hair stand or apparatus 1.

Along with the water boiler, in at least one embodiment, there are a plurality of hooks, such as twenty or more hooks 34 that may be able to fold in and out; the hooks 34 go all the way around tube 4, except for the gap or area 4*a* where the client's neck fits. The plurality of hooks 34 also have two curved ends on it, in at least one embodiment, to hold an individual's braiding hair.

The third module or feature holds the comb 16 that may be five inches long in at least one embodiment. The comb 16 keeps cold fusions in place, such as combinations of hair strands or extensions 17 and 19, shown in FIG. 2, while a beautician attaches a plurality of hair strands, one by one.

The fourth module or feature, in at least one embodiment, allows "clip In" extensions, and is shown by comb sections 32, which may be fixed to section 2*e* of the plate 2. The fourth module may have an area with a outer arc length for the section 2*e* of six inches, which holds a plurality of small individual metal strips or comb extensions 32, such as twenty, that are about an inch long to attach each row of extensions.

The height measurements for this adjustable hair stand or apparatus 1, in accordance with at least one embodiment, may be between thirty inches and thirty-nine and one half inches, measured from the top surface of top plate 2 to the bottom surface of base 14, which allows someone to sit comfortably and work with the apparatus 1. The tube 4 may have a circular disc cross section having a diameter of two inches, and the tube 4 may form a substantially circular shape having a diameter of twenty inches, i.e. substantially circular except for the gap 4*a*. The combination of top plate 2, tube 4, and bottom plate 6 may also be able to rotate in the directions C1 and C2 and tilt.

One plastic basket, such as for receptacle 8 may be used to hold hair, in the inner chamber 8*a*.

Four wheels, typically located at four quadrants to provide proper support, such as wheels 60, 62, 64, and a wheel opposite wheel 62, not shown, may be used to glide the hair stand or apparatus 1 to wherever a beautician desires to put it. The wheels 60, 62, and 64, and a wheel opposite wheel 62 may be protected by a plastic cover.

To assist with installing wefts, in at least one embodiment, a weft feeder is provided with the hair stand or apparatus 1 of the present invention, as well as the basket or receptacle 8. The basket or receptacle 8 holds the hair and may be fed through a weft holder, not shown underneath the basket or receptacle 8.

In at least one embodiment, there is an automatic stopper used to hold the hair in place and a blade 24*a* which has a cover over it for safety reasons. The blade 24*a* is used to cut the weft to the desired length that the hair stylist needs. The weft feeder has a double slot 40*b* and 40*d*, because hair goes in slot 40*b* and is fed through the other side 40*d*. The weft feeder keeps hair in place so that it doesn't fall underneath back into the basket 8. There is also a tray or section of top plate 2 with a small area to hold needles 30 and thread. A plastic stick, not shown, may be provided to place a thread onto to make sure the thread is stationary while a needle is being threaded.

Figure 4:
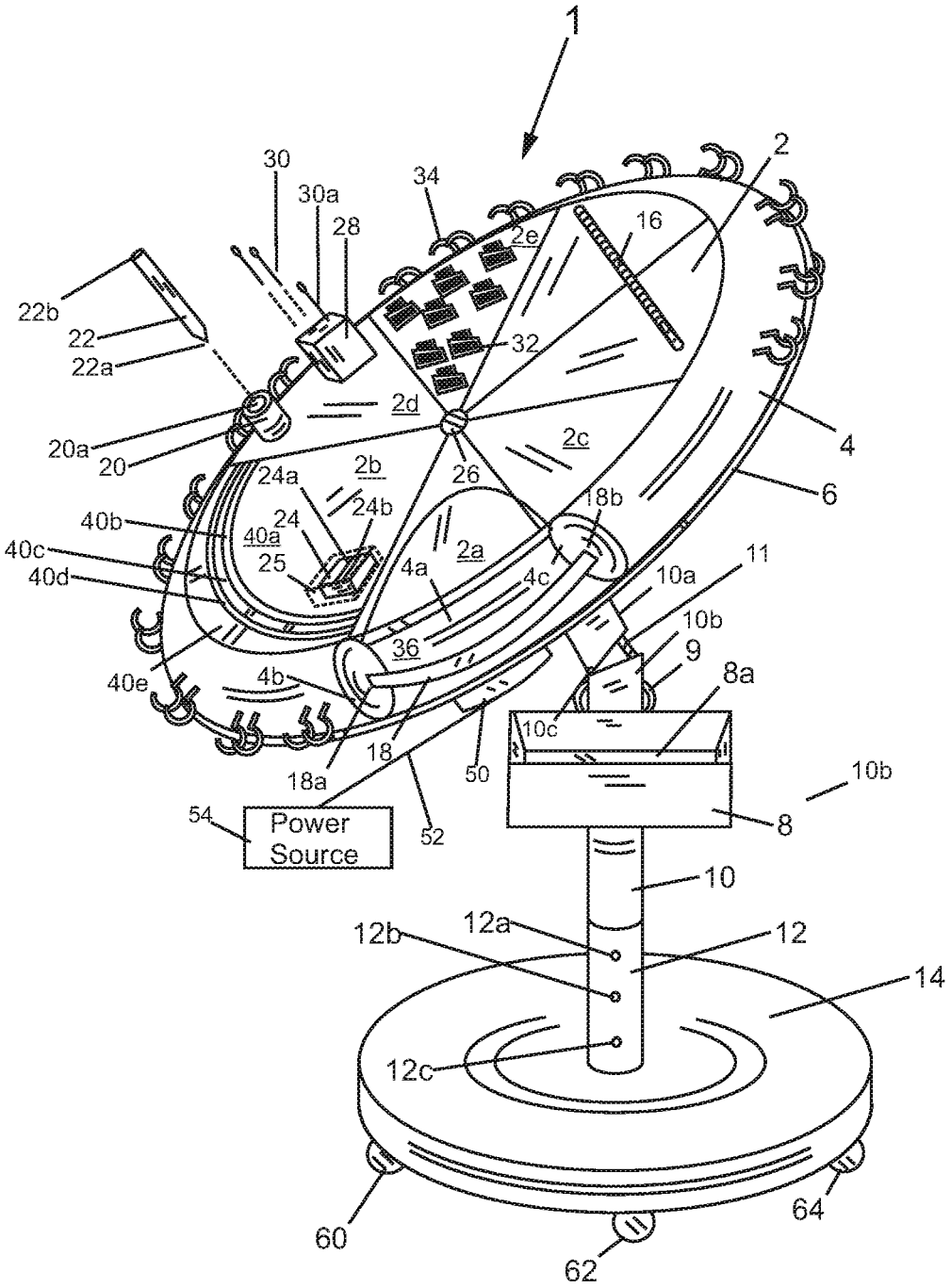
FIG. 4 shows a perspective view of the apparatus of FIG. 1, shown in a third state, where the plate 2 and various attached components have been placed in a tilted state.

The second module, including pie section 2*a* and bowl 36, may be a hair braiding section. The "U Shape" section, where gap 4*a* of the tube 4 is, of the second module is an area where the client's neck can fit comfortably into the stand or apparatus 1. The "U Shape" section is able to tilt as shown in FIG. 4, for example, to make it easier for the client and the beautician to proceed with completing the hair style. With the hair braiding section, there are additional pieces used to assist, such as the water boiler, which includes bowl 36. The water boiler is used when beauticians are braiding hair and afterwards the hair is dipped in hot water, in inner chamber 36*a* of bowl 36 to assist with a cleaner and sleeker look and brings a bit more shine to the finished style.

The fourth module to add to the hair braiding section is the typically foldable hooks 34 that go all the way around the tube 4 except for the neck area or gap 4*a* to hold the synthetic or human braiding hair. Each hook of hooks 34 may have two curved additional hooks to hold the hair whether they have the three pieces of hair together to start braiding or three strands of hair that is separately taken apart so that the stylist can mend all three pieces to start their braid. Also, there may be a metal latch, not shown, that is four inches long and moves in a forward backward motion and snaps into place to hold larger amounts of hair as well.

A fifth feature to a hair stand, in accordance with an embodiment of the present invention, is a section used for clip in extensions, such as comb sections 32. In the end these extensions with the clips attached will go onto the client's natural hair. There are thin metal strips for comb sections 32 which will hold the "clip-in" installments into place while the beautician is getting ready to install the extensions piece by piece onto the client's natural hair.

Lastly, a sixth module may be a cold/hot fusion holder, which includes individual strands of hair put together and bonded together. It creates thicker strands of hair and can create thicker and longer hair for the client. The beautician sits the thicker strands inside of a comb in between each tooth. One by one the strands are attached to the client's natural hair, providing the desired style needed.

In at least one embodiment, the each of the hooks 34 would be part of a pair, such that there is one stem and two hooks on the end of the stem.

In at least one embodiment the sections 2*a*, 2*b*, and 2*c* may be seamlessly connected along with top plate or as part of top plate 2, such that there are substantially no lines on the top of the device.

In at least one embodiment, the tube 4 may not be tube shaped.

The wire or metal bar 18 that's connected between ends 4*b* and 4*c* of the tube 4, may be much thicker than shown in FIGS. 1-4. The wire or metal bar 18 may be a latch that can swing from left to right, i.e. end 18*a* may be configured to be removably attached at 4*b*, so it can be detached and swung open, while still attached at end 18*b*.

The top plate 2 turns in the directions C1 and C2 and also is connected to section 10*a* of member or pole 10 so that the top plate 2 and section 10*a* can tilt with respect to the section 10*b* of the pole 10 as shown in FIG. 4. The top plate 2 and components as shown in FIG. 4 may be supported in the tilted position by a member 11. Since the top plate 2 can be rotated in the directions C1 and C2, this allows the top plate to be placed in any orientation where in the tilted state of FIG. 4 or in the state of FIG. 1. The section 10*a* of the pole or vertical member 10 may be attached to the section 10*b* of the pole or vertical member 10 by a hinge 10*c* shown in FIGS. 1-4, so that the section 10*a* can pivot, rotate, and/or change in orientation with respect to the section 10*b*, while being attached to section 10*b* through the hinge 10*c*, as shown by FIG. 4.

The receptacle or basket 8 may have a caged look.

In at least one embodiment, there may be wheels 60, 62, and 64 attached under surface of the base 14, along with an additional wheel opposite wheel 62, not shown. The wheels 60, 62, and 64 allow the apparatus 1 to be moved easily from location to location.

In at least one embodiment, the base 14 may be more of a trapezoidal shape to protect wheels and an electrical cord, such as cord 52 shown in FIG. 4.

In at least one embodiment, the apparatus 1 allows hair stylists to become more efficient and more organized in their work. They will be able to provide hair styling services in shorter time windows and they will be able to maintain organized work spaces throughout the day with less effort.

In at least one embodiment, by providing all installments with the apparatus 1 it gives a stylist more than one option to install different types of hair extensions. The hair can be prepped on the top plate 2 of the trolley or the apparatus 1 so that the stylist does less of a "stop and go" motion. This trolley or apparatus 1 provides more of a "one stop shop" solution, making it less time consuming while providing structure and a neater workspace.

The apparatus 1 provides a more time efficient tool that's providing more structure to the workplace for the beautification industry.

Doing hair is time consuming, and generally known work places for doing hair are cluttered. The apparatus 1 provides more structure for a stylist, bringing a more time efficient tool that's providing more structure to the workplace.

A stylist's client will not feel obligated to assist in holding hair. A hair stylist's client will feel more comfortable in a structured setting and can expect quicker installment times provided by the beautician because the apparatus 1 in one or more embodiments.

In at least one embodiment, the apparatus 1 may be compact. The apparatus 1 may come with a wig clamp to assist in creating wigs. The apparatus 1 may include eye opening to hold combs.

The apparatus 1 in one or more embodiment, may provide a large impact due to a high level of convenience The apparatus 1, in one or more embodiments, allows hair stylists to become more efficient and more organized in their work. They will be able to provide hair styling services in shorter time windows and they will be able to maintain organized work spaces throughout the day with less effort.

In at least one embodiment, by providing all installments on this product it gives the stylist more than one option to install different types of hair extensions. The hair can be prepped on the trolley so that the stylist does less of a "stop and go" motion. This trolley would provide more of a "one stop shop" solution. This makes it less time consuming while providing structure and a neater workspace.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a vertical member;

a top plate rotatably mounted to the vertical member;

a bowl connected to the top plate so that the bowl rotates with respect to the vertical member when the top plate rotates; and wherein the top plate has at least a first section which is configured to be placed in a first state in which the first section covers the majority of an opening at the top of the bowl, and in a second state in which the first section does not cover the majority of the opening at the top of the bowl;

wherein the bowl is configured to retain water; and further comprising a tube fixed to the top plate; and wherein the top plate is substantially circular and the tube surrounds the top plate except for a gap at a location adjacent the bowl.

2. The apparatus of claim 1 further comprising a plurality of hooks fixed to the tube; and wherein each of the plurality of hooks is configured to hold one or more hair extensions.

3. The apparatus of claim 1 further comprising a cutting device fixed at a location to the top plate, wherein when the top plate changes in orientation, the cutting device remains fixed at the location to the top plate; and wherein the cutting device is configured to cut hair.

4. The apparatus of claim 3 wherein the top plate has first and second arcuate slots separated by an arcuate band; and wherein one or more hairs is configured to be inserted into the first arcuate slot, underneath the arcuate band, and then through the second arcuate slot;

and wherein the cutting device is fixed at the location to the top plate and the first and second arcuate slots are located so that a hair is configured to be cut by the cutting device while being held by the first and second slots.

5. The apparatus of claim 1 further comprising a foam needle holder fixed to the top plate.

6. The apparatus of claim 1 further comprising a first type of comb fixed to a second section of the top plate;

a second type of comb fixed to a third section of the top plate;

wherein the first type of comb is at least twice as long as the second type of comb;

and wherein the first type of comb and the second type of comb are configured to hold one or more hair extensions.

7. The apparatus of claim 1 wherein the top plate is configured to tilt with respect to the vertical member.

8. The apparatus of claim 1 further comprising a base; and a basket fixed to the vertical member at a location between the top plate and the base;

and wherein the basket is an open box structure which includes an inner chamber which is bordered by a peripheral wall and a bottom surface.

9. An apparatus comprising:

a vertical member;

a top plate rotatably mounted to the vertical member;

a bowl connected to the top plate so that the bowl rotates with respect to the vertical member when the top plate rotates; and wherein the top plate has at least a first section which is configured to be placed in a first state in which the first section covers the majority of an opening at the top of the bowl, and in a second state in which the first section does not cover the majority of the opening at the top of the bowl;

wherein the bowl is configured to retain water; and further comprising a heater connected to the bowl at a location underneath the bowl, which is configured to be powered to provide heat to the bowl to boil water in an inner chamber of the bowl.

10. An apparatus comprising:

a vertical member;

a top plate rotatably mounted to the vertical member;

a bowl connected to the top plate so that the bowl rotates with respect to the vertical member when the top plate rotates; and wherein the top plate has at least a first section which is configured to be placed in a first state in which the first section covers the majority of an opening at the top of the bowl, and in a second state in which the first section does not cover the majority of the opening at the top of the bowl;

wherein the bowl is configured to retain water; and further comprising a cutting device fixed at a location to the top plate, wherein when the top plate changes in orientation, the cutting device remains fixed at the location to the top plate; and wherein the cutting device is configured to cut hair.

11. A method comprising the steps of:

placing water into an inner chamber of a bowl; and heating the water in the inner chamber of the bowl with a heating element; and wherein the bowl is part of an apparatus comprising:

a vertical member;

a top plate rotatably mounted to the vertical member;

the bowl connected to the top plate so that the bowl rotates with respect to the vertical member when the top plate rotates; and wherein the top plate has at least a first section which is configured to be placed in a first state in which the first section covers the majority of an opening at the top of the bowl, and in a second state in which the first section does not cover the majority of the opening at the top of the bowl;

wherein the bowl is configured to retain water; and wherein the apparatus further includes a tube fixed to the top plate; and wherein the top plate is substantially circular and the tube surrounds the top plate except for a gap at a location adjacent the bowl.

12. The method of claim 11 wherein the apparatus further includes a plurality of hooks fixed to the tube; and wherein each of the plurality of hooks is configured to hold one or more hair extensions.

13. The method of claim 11 wherein the apparatus further includes a cutting device fixed at a location to the top plate, wherein when the top plate changes in orientation, the cutting device remains fixed at the location to the top plate; and wherein the cutting device is configured to cut hair.

14. The method of claim 13 wherein the top plate has first and second arcuate slots separated by an arcuate band; and wherein one or more hairs is configured to be inserted into the first arcuate slot, underneath the arcuate band, and then through the second arcuate slot;

and wherein the cutting device is fixed at the location to the top plate and the first and second arcuate slots are located so that a hair is configured to be cut by the cutting device while being held by the first and second slots.

15. The method of claim 11 wherein the apparatus includes a foam needle holder fixed to the top plate.

16. The method of claim 11 wherein the apparatus includes a first type of comb fixed to a second section of the top plate; and a second type of comb fixed to a third section of the top plate;

wherein the first type of comb is at least twice as long as the second type of comb;

and wherein the first type of comb and the second type of comb are configured to hold one or more hair extensions.

17. The method of claim 11 wherein the top plate is configured to tilt with respect to the vertical member.

18. The method of claim 11 wherein the apparatus further includes a base; and a basket fixed to the vertical member at a location between the top plate and the base;

and wherein the basket is an open box structure which includes an inner chamber which is bordered by a peripheral wall and a bottom surface.

19. A method comprising the steps of:

placing water into an inner chamber of a bowl; and heating the water in the inner chamber of the bowl; and wherein the bowl is part of an apparatus comprising:

a vertical member;

a top plate rotatably mounted to the vertical member;

the bowl connected to the top plate so that the bowl rotates with respect to the vertical member when the top plate rotates; and wherein the top plate has at least a first section which is configured to be placed in a first state in which the first section covers the majority of an opening at the top of the bowl, and in a second state in which the first section does not cover the majority of the opening at the top of the bowl;

wherein the bowl is configured to retain water;

wherein the apparatus further includes a heater connected to the bowl at a location underneath the bowl, which is configured to be powered to provide heat to the bowl to boil water in the inner chamber of the bowl.

20. A method claim comprising the steps of:

placing water into an inner chamber of a bowl; and heating the water in the inner chamber of the bowl; and wherein the bowl is part of an apparatus comprising:

a vertical member;

a top plate rotatably mounted to the vertical member;

the bowl connected to the top plate so that the bowl rotates with respect to the vertical member when the top plate rotates; and wherein the top plate has at least a first section which is configured to can be placed in a first state in which the first section covers the majority of an opening at the top of the bowl, and in a second state in which the first section does not cover the majority of the opening at the top of the bow;

wherein the bowl is configured to retain water;

and wherein the apparatus further includes a cutting device fixed at a location to the top plate, wherein when the top plate changes in orientation, the cutting device remains fixed at the location to the top plate; and wherein the cutting device is configured to cut hair.

* * * * *